US007048126B2

(12) United States Patent
Adams

(10) Patent No.: US 7,048,126 B2
(45) Date of Patent: May 23, 2006

(54) DESK PAD ORGANIZER SYSTEM

(75) Inventor: Duane D. Adams, Sidney, NY (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 10/646,520

(22) Filed: Aug. 22, 2003

(65) Prior Publication Data

US 2005/0040070 A1 Feb. 24, 2005

(51) Int. Cl.

| | |
|---|---|
| ***B65D 1/34*** | (2006.01) |
| ***A45C 11/34*** | (2006.01) |
| ***G09D 3/00*** | (2006.01) |
| ***B43M 17/00*** | (2006.01) |

(52) U.S. Cl. ..... 206/564; 206/214; 40/107; 40/358

(58) Field of Classification Search ..... 206/214, 206/224, 232, 576, 1.7, 371, 484, 557, 562–564, 206/460, 813, 558, 450, 473, 418, 419; D19/20–23, D19/75, 77, 78, 95, 99; 40/107, 358; 248/346.01, 248/346.03; 211/119.005; 220/23.2, 23.4, 220/23.6

See application file for complete search history.

(56) References Cited

U.S. PATENT DOCUMENTS

| | | | | | |
|---|---|---|---|---|---|
| 811,334 | A | * | 1/1906 | Smigel | 40/358 |
| 1,331,995 | A | * | 2/1920 | McMullen | 40/358 |
| 1,528,400 | A | | 3/1925 | Busch | 283/117 |
| D114,382 | S | * | 4/1939 | Kemp | D19/22 |
| 3,744,435 | A | * | 7/1973 | Tracy et al. | 108/26 |
| 3,927,767 | A | * | 12/1975 | Sato et al. | 206/589 |
| 4,176,743 | A | | 12/1979 | Fitzpatrick | 206/214 |
| 4,362,248 | A | | 12/1982 | Vilanova | 211/50 |
| 4,570,793 | A | | 2/1986 | O'Neil et al. | 206/371 |
| 4,768,298 | A | * | 9/1988 | Polhemus et al. | 40/358 |
| 4,964,519 | A | * | 10/1990 | Sugarman et al. | 211/50 |
| 5,022,170 | A | | 6/1991 | House | 40/358 |
| D327,092 | S | * | 6/1992 | Evenson | D19/75 |
| 5,123,191 | A | | 6/1992 | Kim | 40/358 |
| 5,154,498 | A | | 10/1992 | Slater | 312/230 |
| D385,920 | S | * | 11/1997 | Tisbo | D19/75 |
| 5,727,766 | A | * | 3/1998 | Mayo | 248/346.01 |
| 5,948,498 | A | | 9/1999 | Bianco et al. | 428/81 |
| 6,168,127 | B1 | | 1/2001 | Saylor et al. | 248/442.2 |
| 6,175,082 | B1 | * | 1/2001 | Klinger et al. | 248/231.81 |
| D497,953 | S | * | 11/2004 | Adams | D19/75 |

* cited by examiner

*Primary Examiner*—Mickey Yu
*Assistant Examiner*—J. Gregory Pickett
(74) *Attorney, Agent, or Firm*—Lawrence P. Trapani

(57) ABSTRACT

A desk organizer tray, comprising a tray portion, an extension portion extending from the tray portion, and an attachment element applied to the extension portion. The tray portion contains a receptacle for holding desktop items. The tray portion is constructed of a plurality of superimposed board members, each of which contains a hole pattern. The hole patterns of the board members are in registration with one another to form the receptacle. The extension portion includes a board member that extends from the tray portion. The board members of the tray portion are mounted on the board member of the extension portion. The attachment element is applied to the board member of the extension portion. The attachment element serves to attach a desk pad to the extension portion, adjacent to the tray portion.

17 Claims, 3 Drawing Sheets

DESK PAD ORGANIZER SYSTEM

BACKGROUND OF THE INVENTION

1. Technical Field

The present invention relates generally desktop accessories, and more particularly to a planning and organizational aid for the desktop.

2. Background Art

Various items and implements normally associated with working at a desk include pens, pencils, paper clips, notepads, adhesive-backed notes, push pins, rubber bands, and the like. Such items and implements are hereinafter referred to as "desktop items."

Systems for organizing and holding desktop items have been proposed, as evidenced by the following U.S. patents: U.S. Pat. No. 4,768,298 to Polhemus et al.; U.S. Pat. No. 4,570,793 to O'Neil et al.; and U.S. Pat. No. 4,176,743 to Fitzpatrick. These patents disclose modular and reconfigurable organizing systems. The patents to Polhemus and Fitzpatrick also disclose the use of day calendars in conjunction with such systems. However, none of these patents suggests the concept of joining a desk pad or supplementary work surface to an organizing system. Thus, the systems disclosed in these patents are somewhat limited in utility.

Desk pads and supplementary work surfaces (i.e., supplementary to the desktop) have been propose, as evidenced by the following U.S. patents: U.S. Pat. No. 5,154,498 to Slater; U.S. Pat. No. 5,123,191 to Kim; and U.S. Pat. No. 5,022,170 to House. The patents to Slater and House disclose the concept of including an organizing tray (for desktop items) along with a supplementary work surface; and Kim discloses the use of a calendar desk pad which also serves as a work surface. However, these patents fail to recognize the utility of joining a desk organizing tray with a desk pad. Also, the organizing trays in Slater and House are built into the work surface, thus selection of a particular desk pad for use with the trays is impossible. The term "desk pad," as used herein means a writing pad or tablet large enough to also serve as a supplementary work surface.

Wall-mount systems that juxtapose wire-bound calendars with organizing trays have been employed, as evidenced by U.S. Pat. No. 5,948,498 to Bianco et al. However, such systems would not be suitable for desktop applications, because they do not present a large enough work surface. In addition, the calendar is not fixedly connected to the organizing tray, thus each component could be separated and displaced.

OBJECTS AND SUMMARY OF THE INVENTION

It is therefore an object of the present invention to provide a desk pad organizer system that avoids the limitations and problems associated with the prior art.

It is another object of the present invention to provide a desk pad organizer system that includes an organizer tray for organizing and holding desktop items and includes a desk pad.

It is a further object of the present invention to provide a desk organizer tray that allows the user to select a particular desk pad to be used with the tray.

It is yet another object of the present invention to provide a desk pad organizer system that can be manufactured by a process alternative to injection molding or vacuum forming.

It is yet a further object of the present invention to provide a desk pad organizer system that is easily and cost effectively manufactured.

These and other objects are attained in accordance with the present invention, wherein there is provided a desk organizer tray. The desk organizer tray comprises a tray portion, an extension portion, and an attachment element applied to the extension portion. The tray portion contains a receptacle for holding desktop items. The tray portion is constructed of a plurality of superimposed board members, each of which contains a hole pattern. The hole patterns of the board members are in registration with one another to form the receptacle. The extension portion includes a board member that extends from the tray portion. The board members of the tray portion are mounted on the board member of the extension portion. The attachment element is applied to the board member of the extension portion. The attachment element serves to attach a desk pad to the extension portion, adjacent to the tray portion.

In one embodiment, the length of the board member of the extension portion is substantially less than the length of the desk pad to be attached. In another embodiment, the length of the board member of the extension portion is substantially equal to the length of the desk pad to be attached. In the latter embodiment, the board member of the extension portion can serve as a backer for a desk pad.

A method of assembling a desk pad organizer system is also contemplated by the present invention. The method comprises the steps of: (a) providing a desk pad; (b) providing a desk organizer tray including a tray portion, an extension portion, and an adhesive element applied to the extension portion; and (c) applying the desk pad to the adhesive element on the extension portion and locating the desk pad adjacent to the tray portion.

BRIEF DESCRIPTION OF THE DRAWING

Further objects of the present invention will become apparent from the following description of the preferred embodiments with reference to the accompanying drawing, in which.

DETAILED DESCRIPTION OF THE PREFERRED EMBODIMENTS

Referring now to FIGS. 1–3 and 3A, a first embodiment of the present invention is shown. A desk organizer tray 10 (FIG. 2) comprises a tray 12, an extension member 14 extending from tray 12, and an attachment element 15 applied to extension member 14. Tray 12 contains several receptacles 16*a*–16*g* for holding various desktop items.

Figure 5:
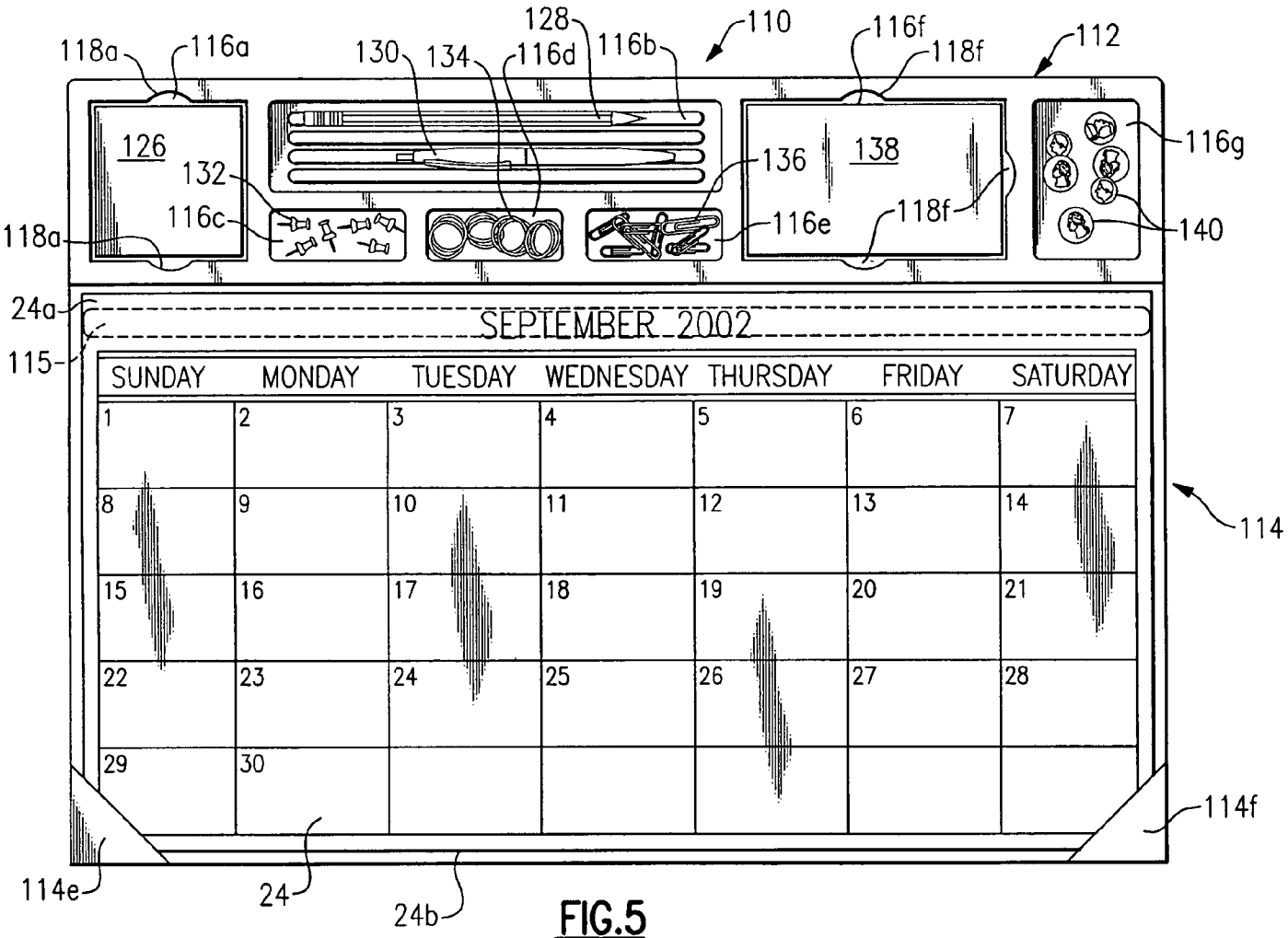
FIG. 5 is a top plan view of the desk organizer tray of FIG. 4, with the calendar desk pad installed thereon.

Receptacle 16*a* is configured and dimensioned to closely receive and hold a pad of adhesive-backed notes (see FIG. 5). The opening to receptacle 16*a* is defined by a perimeter 17*a* which contains two opposed finger recesses 18*a*. Receptacle 16*b* is configured as a pen and pencil tray, and contains four recesses 17*b* to cradle pens, pencil or other writing implements (see FIG. 5). Receptacles 16*c*–16*e* and 16*g* are general purpose receptacles for holding such items as push pins, rubber bands, paper clips, coins, and the like (see FIG. 5). Receptacle 16*f* is configured and dimensioned to closely receive and hold a notepad (see FIG. 5). The opening to receptacle 16*f* is defined by a perimeter 17*f* which contains three finger recesses 18*f*. Finger recesses 18*a* and 18*f* are each configured and dimensioned to accept a person's finger and facilitate manual removal of, e.g., a note pad from receptacles 16*a* and 16*f*.

Attachment element 15 is preferably an adhesive element such as a strip of double-sided tape, glue or a pressure sensitive adhesive substance. As shown, attachment element 15 is preferably applied directly to extension member 14, in the form of a neat band or strip. The purpose of attachment element 15 is to provide a means for attaching a desk pad to extension 14 and for locating the desk pad adjacent to tray 12. This is shown, for a second embodiment, in FIG. 4.

Figure 1:
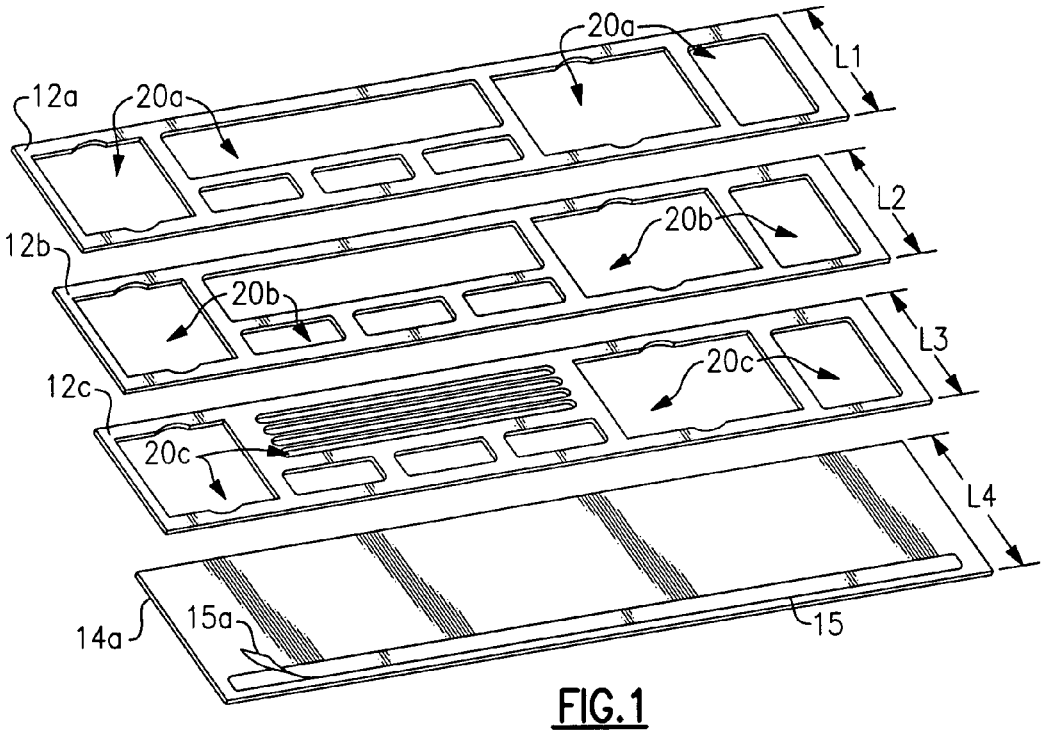
FIG. 1 is an exploded view showing the construction of one embodiment of a desk organizer tray of the present invention.
Figure 2:
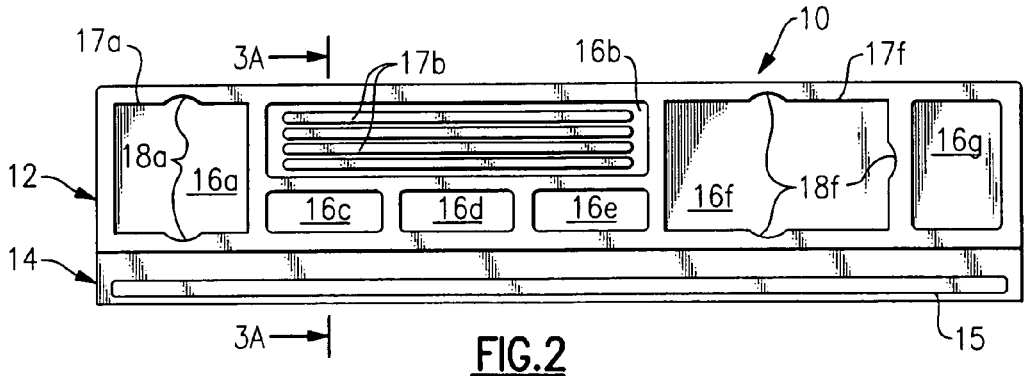
FIG. 2 is a top plan view of an assembled desk organizer tray of the present invention.

As best shown in FIG. 1, tray 12 is constructed of three superimposed boards 12*a*, 12*b* and 12*c*. Boards 12*a*, 12*b* and 12*c* contain die-cut hole patterns 20*a*, 20*b* and 20*c*, respectively. As boards 12*a*–12*c* are superimposed, hole patterns 20*a*–20*c* are in registration with one another to form receptacles 16*a*–16*g*. Boards 12*a*–12*c* are preferably made of 50 pt black chipboard material or EVA foam material, and they are laminated or glued together to form a single article. The lengths, L1, L2 and L3, of boards 12*a*–12*c* are the same, so they form a flat face 22 when assembled (see FIG. 3). Extension member 14 is constructed from a single board 14*a* (FIG. 1). The completed assembly of boards 12*a*–12*c* is laminated or glued onto board 14*a*. Board 14*a* serves as a floor for receptacles 16*a*–16*g*. Board 14*a* has a length L4 that is greater than lengths L1–L3 of boards 12*a*–12*c*. Board 14*a* extends from tray 12 by a distance, L4 minus L1. In the embodiment shown in FIGS. 1–3 and 3A, board 14*a* extends from tray 12 a length that is substantially less than the length of a desk pad to be attached to board 14*a*.

Figure 4:
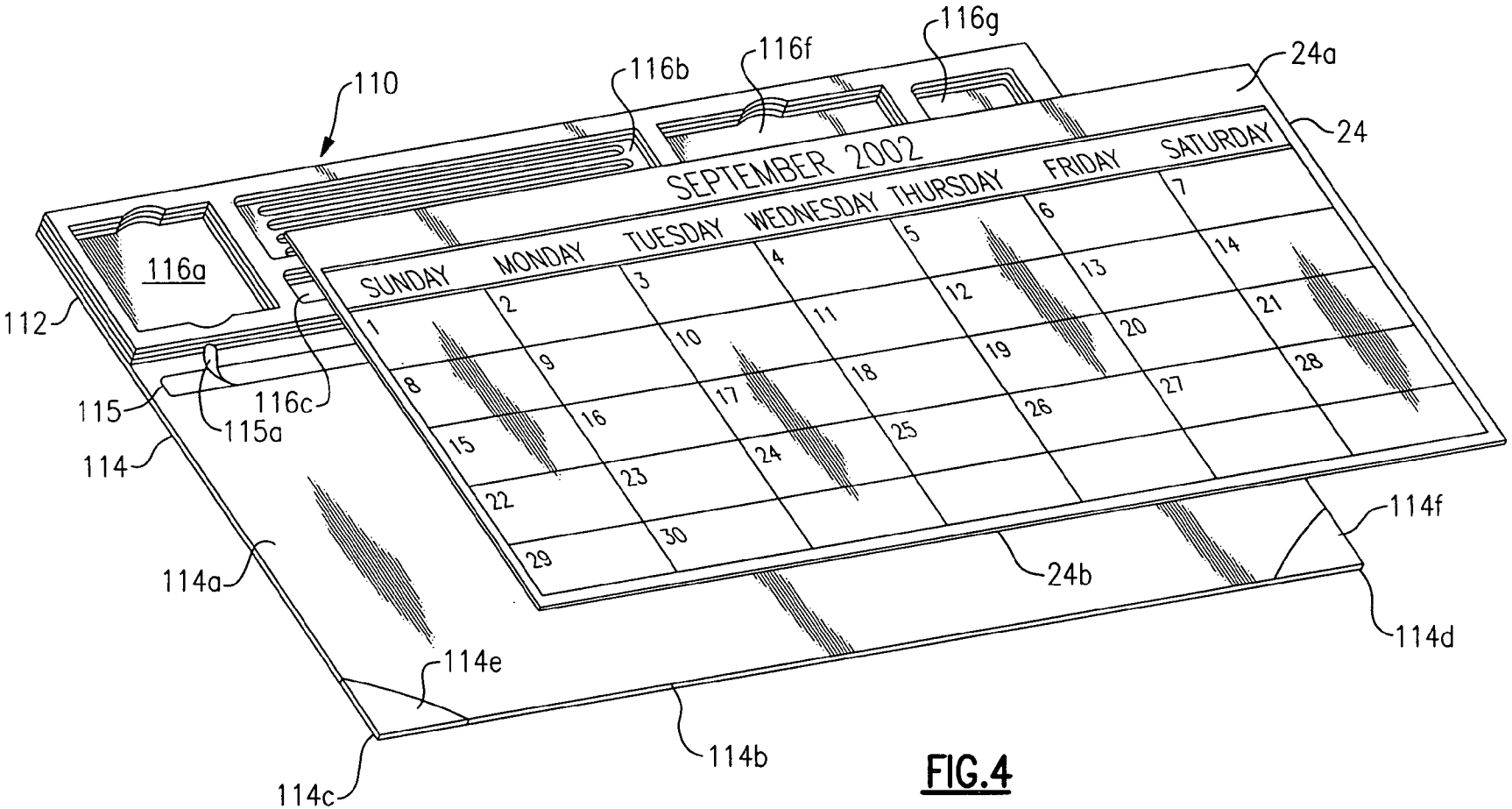
FIG. 4 is a perspective view of a second embodiment of a desk organizer tray of the present invention, shown with a calendar desk pad.

FIG. 4 shows a calendar desk pad 24. Pad 24 includes a number of sheets of paper of the same size, each printed with a calendar month, stacked one on top of the other and bound together at a top end 24*a*. At a bottom end 24*b*, the monthly calendar sheets are loose. Each sheet may be torn from pad 24 at perforations (not shown) near top end 24*a*.

Figure 3:
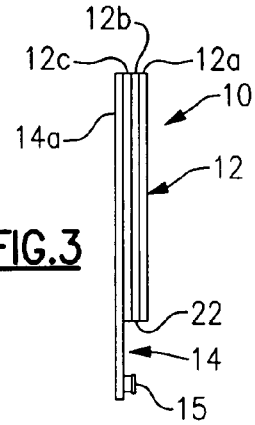
FIG. 3 is a side elevation view of the desk organizer tray of FIG. 2.
Figure 3A:
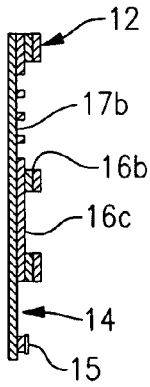
FIG. 3A is a cross-sectional view of the desk organizer tray of FIG. 2, taken along line 3A—3A in FIG. 2.

In the embodiment of FIGS. 1–3 and 3A, calendar desk pad 24 is attached to board 14*a* by applying top end 24*a* to attachment element 15. Pad 24 is oriented such that top end 24*a* abuts face 22 of tray 12 (FIG. 3). Manual pressure is applied to top end 24*a* to achieve an adhesive bond between pad 24 and board 14*a*. In this embodiment, it is preferred that calendar pad 24 have its own stiff backer. In the second embodiment of the present invention (FIGS. 4–6), the extension member serves as a stiff backer for the desk pad.

Figure 6:
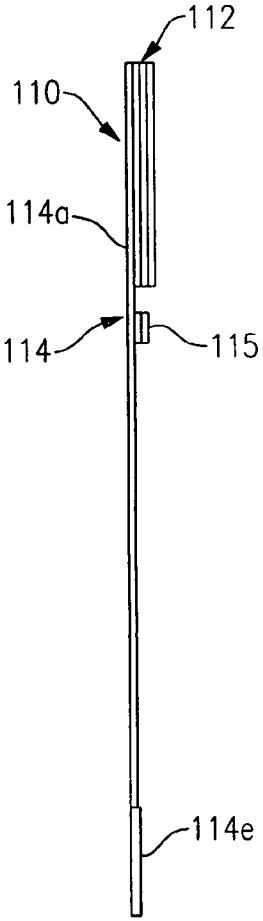
FIG. 6 is a side elevation view of the desk organizer tray of FIG. 4.

Referring to FIGS. 4–6, the second embodiment of the present invention is shown. A desk organizer tray 110 comprises a tray 112, an extension member 114, and an attachment element 115. Tray 112 contains several receptacles 116*a*–116*g* for holding various desktop items. The second embodiment is identical to the first embodiment (FIGS. 1–3 and 3A), except that extension member 114 extends from tray 112 a length substantially equal to the length of calendar desk pad 24. Desk organizer tray 110 is also constructed of chipboards as described with respect to the first embodiment (FIG. 6).

Extension member 114 is made of a single rectangular-shaped chipboard 114*a* (FIG. 4). Attachment element 115 is preferably an adhesive strip, and is applied to board 114*a*, near tray 112, as shown in FIG. 4. Board 114*a* has a distal end 114*b* terminating at a pair of corners 114*c* and 114*d*. A pair of corner pockets 114*e* and 114*f* are mounted at corners 114*c* and 114*d*, respectively. Pockets 114*e* and 114*f* receive the corners of bottom end 24*b* of calendar pad 24 and retain the loose ends of the calendar sheets flat against board 114*a* (See FIG. 5). In this embodiment, a desk pad without a stiff backer may be used, because board 114*a* serves as the backer.

As shown in FIG. 5, receptacles 116*a*–116*g* each contain a desktop item or items. Receptacle 116*a* contains an adhesive-backed note pad 126; receptacle 116*b* contains a pencil 128 and a pen 130; receptacle 116*c* contains push pins 132; receptacle 116*d* contains rubber bands 134; receptacle 116*e* contains paper clips 136; receptacle 116*f* contains a notepad 138; and receptacle 116*g* contains coins 140. Receptacles 116*a* and 116*f* each contain a pair of opposed finger recesses 118*a* and 118*f*, respectively, which facilitate manual removal of note pads 126 and 138. Receptacle 116*f* contains a third finger recess 118*f*, oriented at right angles to the other two recesses. This third recess offers further assistance with manual removal of notepad 138.

As with the first embodiment, the second embodiment is assembled by locating top end 24*a* of calendar pad 24 adjacent to tray 112 and applying end 24*a* down against adhesive strip 115. By applying pressure to end 24*a*, a secure adhesive bond between calendar pad 24 and extension member 114 is achieved. The two distal corners of pad 24 (at end 24*b*) are then inserted into corner pockets 114*e* and 114*f*.

As indicated above, attachment elements 15 and 115 are preferably implemented as an adhesive strip, such as double-sided tape or a glue strip. The exposed adhesive surface of attachment elements 15 and 115 is protected by a wax paper strip or other suitable substrate 15*a*, 115*a* that can be easily removed without upsetting the adhesive surface. Just prior to installation of desk pad 24 onto tray 12 or tray 112, the wax paper strip or substrate 15*a* or 115*a* is removed.

While the preferred embodiments of the invention have been particularly described in the specification and illustrated in the drawings, it should be understood that the invention is not so limited. Many modifications, equivalents and adaptations of the invention will become apparent to those skilled in the art without departing from the spirit and scope of the invention, as defined in the appended claims.

What I claim is:

1. A desk organizer tray, comprising:

a tray portion containing a receptacle for holding desktop items, said tray portion being constructed of a plurality of superimposed board members, each of the plurality of board members containing a hole pattern, the hole patterns of the plurality of board members being in registration with one another to form the receptacle;

an extension portion including a board member that extends from said tray portion, the plurality of board members of said tray portion being mounted on the board member of said extension portion, the length of the board member of said extension portion being greater than the lengths of the plurality of board members of said tray portion; and means, applied to the board member of said extension portion, for attaching a desk pad to said extension portion and adjacent to said tray portion.

2. The desk organizer tray of claim 1, wherein the receptacle is configured and dimensioned to closely receive and hold an adhesive-backed note pad.

3. The desk organizer tray of claim 1, wherein the receptacle is configured and dimensioned to receive and support a notepad.

4. The desk organizer tray of claim 1, wherein the receptacle is configured as a pen tray.

5. The desk organizer tray of claim 1, wherein the receptacle is configured as a paper clip tray.

6. The desk organizer tray of claim 1, wherein said tray portion contains a plurality of receptacles for holding desktop items.

7. The desk organizer tray of claim 1, wherein the opening of the receptacle is defined by a perimeter, the perimeter containing a recess configured and dimensioned to accept a person's finger and facilitate manual removal of a desktop item situated in the receptacle.

8. The desk organizer tray of claim 7, wherein the perimeter of the receptacle contains a pair of opposed recesses, each configured and dimensioned to accept a person's finger and facilitate manual removal of a desktop item situated in the receptacle.

9. The desk organizer tray of claim 1, wherein the board member of said extension portion extends from said tray portion a length that is less than the length of a desk pad to be attached to said extension portion.

10. The desk organizer tray of claim 1, wherein the board member of said extension portion extends from said tray portion a length that is substantially equal to the length of a desk pad to be attached to said extension portion.

11. The desk organizer tray of claim 10, wherein the board member of said extension portion is rectangular-shaped with a pair of corners at its distal end, the board member of said extension portion including a pair of corner pockets at the pair of corners, respectively, for receiving and retaining a bottom end of a desk pad.

12. The desk organizer tray of claim 1, wherein the board member of said extension portion extends from said tray portion a length sufficient to serve as a backer for a desk pad to be attached to said extension portion.

13. The desk organizer tray of claim 1, wherein said attaching means includes a strip of double-sided tape applied to the board member of said extension portion.

14. The desk organizer tray of claim 1, wherein said attaching means includes glue applied to the board member of said extension portion.

15. The desk organizer tray of claim 1, further comprising a desk pad, said desk pad being attached to the board member of said extension portion and being located adjacent to said tray portion.

16. The desk organizer tray of claim 15, wherein said desk pad is a calendar desk pad.

17. A desk organizer tray, comprising:

a tray portion containing a receptacle for holding desktop items, said tray portion being constructed of a plurality of superimposed board members, each of the plurality of board members containing a hole pattern, the hole patterns of the plurality of board members being in registration with one another to form the receptacle;

an extension portion including a board member that extends from said tray portion, the plurality of board members of said tray portion being mounted on the board member of said extension portion, the length of the board member of said extension portion being greater than the lengths of the plurality of board members of said tray portion;

a desk pad; and means for attaching said desk pad to said extension portion, adjacent to said tray portion.

* * * * *